United States Patent [19]

Yoshiike et al.

[11] Patent Number: 4,899,090

[45] Date of Patent: Feb. 6, 1990

[54] RARE GAS DISCHARGE LAMP DEVICE

[75] Inventors: Yoshiji Yoshiike, Yokosuka; Yoshinori Satou, Yokohama, both of Japan

[73] Assignee: Kabushiki Kaisha Toshiba, Kawasaki, Japan

[21] Appl. No.: 298,256

[22] Filed: Jan. 17, 1989

Related U.S. Application Data

[63] Continuation of Ser. No. 55,610, May 29, 1987, abandoned.

[30] Foreign Application Priority Data

May 30, 1986 [JP] Japan ..... 61-124974
Aug. 29, 1986 [JP] Japan ..... 61-203348

[51] Int. Cl.[4] ..... H05B 41/00

[52] U.S. Cl. ..... 315/335; 313/572; 313/607

[58] Field of Search ..... 315/70, 239, 248, 261, 315/335; 313/572, 573, 576, 5, 594, 601, 607, 491

[56] References Cited

U.S. PATENT DOCUMENTS

| | | | |
|---|---|---|---|
| 1,543,973 | 6/1925 | Adams et al. | 313/572 |
| 3,086,140 | 4/1963 | Banios | 315/98 |
| 3,890,540 | 6/1975 | Ott | 315/335 |
| 4,223,247 | 9/1980 | Jacobs et al. | 315/70 |
| 4,492,898 | 1/1985 | Lapatovich et al. | 313/637 |
| 4,645,979 | 2/1987 | Chow . | |

FOREIGN PATENT DOCUMENTS

| | | | |
|---|---|---|---|
| 1012688 | 1/1958 | Fed. Rep. of Germany . | |
| 1065530 | 3/1960 | Fed. Rep. of Germany . | |
| 2644821 | 4/1977 | Fed. Rep. of Germany . | |
| 61-63760 | 4/1986 | Japan . | |
| 2067826 | 7/1981 | United Kingdom | 313/572 |
| 2081498 | 2/1982 | United Kingdom . | |

*Primary Examiner*—Eugene R. LaRoche
*Assistant Examiner*—Robert J. Pascal
*Attorney, Agent, or Firm*—Cushman, Darby & Cushman

[57] ABSTRACT

A rare gas discharge lamp device comprises a bulb with a rare gas sealed therein, a pair of internal electrodes provided within the bulb, a phosphor layer formed on the inner surface of the bulb, a lighting circuit adapted to apply voltage across two internal electrodes to produce a discharge or a positive column between the internal electrodes, and an auxiliary electrode formed on the outer surface of the bulb and extending in the longitudinal direction of the bulb, the positive column being attracted toward the auxiliary electrode, and a window formed on the bulb in a manner to face the auxiliary electrode for emitting visible light to be produced within the bulb.

24 Claims, 5 Drawing Sheets

RARE GAS DISCHARGE LAMP DEVICE

This is a continuation of application Ser. No. 07/055,610, filed May 29, 1987, which was abandoned upon the filing hereof.

This application is related to U.S. patent applications to Dobashi, Ser. No. 07/127,486 filed Dec. 1, 1987 and Dobashi, Ser. No. 07/173,117 filed Mar. 25, 1988.

BACKGROUND OF THE INVENTION

1. Field of the Art

This invention relates to a device having a rare gas discharge lamp with a rare gas sealed in a bulb in place of mercury and, in particular, a rare gas discharge lamp device suitable as a light source for a plain paper copier or a facsimile machine.

2. Description of the Related Art

In the past, fluorescent lamps, one type of low-pressure mercury vapor lamps, have been employed as light exposure sources for a plain paper copier or a facsimile machine. This type of light source requires the following requirements: (1) The light emission portion is of an elongated type to obtain a broad illumination surface; (2) The light output is high to obtain high illumination on the illumination surface; and (3) The light output of the light emission portion is uniform along the longitudinal direction to obtain a uniform illumination level on the illumination surface. In these flourescent lamps, mercury is sealed within the bulb at a partial vapor pressure of about $5\times10^{-5}$ torrs and a rare gas, such as argon gas, is sealed within the bulb at a partial vapor pressure of several torrs to lower the starting voltage. In these lamps, a phosphor layer coated on the inner surface of the bulb is excited by ultraviolet radiation resulting from the mercury atoms within the bulb so that it produces a light emission. The light output of the fluorescent lamp depends upon the mercury vapor pressure within the bulb. The mercury vapor pressure varies depending upon the temperature. Thus the light output of the mercury-sealed fluorescent lamp varies depending upon the ambient temperature of the fluorescent lamp.

A rare gas discharge lamp in which a rare gas such as a xenon gas is filled in place of mercury has been proposed and could be employed as a light source for plain paper copier and facsimile machine. The light output level of a rare gas discharge lamp is generally lower than that of a fluorescent lamp and is affected very little by the ambient temperature. In the rare gas discharge lamp, a glow discharge is produced within the bulb and the phosphor layer on the inner surface of the bulb is excited by the ultraviolet radiation resulting from a positive column of the glow discharge, so that it produces visible light. The light output can be increased by increasing the sealing pressure of the rare gas within the bulb. It is necessary to seal, for example, a xenon gas at a high pressure of a few tens or a few hundreds of torrs in a rare gas discharge lamp to achieve practical light output level. Sealing the rare gas within the bulb at the high pressure level results in the production of a fluctuating narrow positive column. That is, the positive column of the glow discharge, extending in the longitudinal direction of the bulb, fluctuates in the direction of the diameter of the bulb and thus becomes unstable along the axis of the bulb. As a result, the light output is not constant along the longitudinal direction of the bulb due to the varying distance between the positive column and the different phosphor particles that make up the phosphor layer on the inner surface of the bulb. The result is that a very intense light emission at locations near the positive column are produced and a weak light emission at locations remote from the positive column are produced. Prior art rare gas discharge lamps, therefore, will not obtain uniform illumination because the light output level varies from location to location along the longitudinal direction of the bulb.

SUMMARY OF THE INVENTION

It is accordingly the object of this invention to provide a rare gas discharge lamp which can produce a higher light output level uniformly distributed on an illumination surface along the longitudinal direction of the bulb.

According to this invention a rare gas discharge lamp device includes the following elements. A lamp has a tubular bulb with a rare gas sealed therein. A pair of internal electrodes are provided within the bulb and set apart from each other in the longitudinal direction of the bulb, the electrodes serving to produce a positive column therebetween when a predetermined voltage is applied between the electrodes. A phosphor layer is formed on the inner surface of the bulb. A lighting circuit applies voltage across the internal electrodes to produce a positive column across the internal electrodes.

An auxiliary electrode is provided along the outer surface of the bulb, extends in the longitudinal direction of the bulb and has a length substantially equal to the distance between the internal electrodes. Means for producing a potential difference between the auxiliary electrode and each of the internal electrodes are connected to the auxiliary electrode to produce a potential difference relative to the positive column, wherein a window is formed on the bulb facing the auxiliary electrode and extends in the longitudinal direction of the bulb so that, within the bulb, the visible light is emitted, as an output, through the window due to a discharge occurring across the internal electrodes.

In the rare gas discharge lamp described above, a glow discharge occurs as a positive column, across the internal electrodes in the bulb through the lighting circuit to produce ultraviolet radiation. As a result, the ultraviolet radiation is converted by the phosphor layer to visible light, which is in turn directed, through the window, at an illumination surface. Because of the potential difference between the auxiliary electrode and the respective electrode, the positive column is attracted toward the auxiliary electrode and located in proximity to the phosphor layer so that it extends uniformly along the longitudinal direction of the bulb. As a result, the rare gas discharge lamp device produces a higher and stable light output which is constant along the longitudinal direction of the bulb.

BRIEF DESCRIPTION OF THE DRAWINGS

These and other advantages of the present invention may be appreciated from studying the following detailed description of the presently preferred exemplary embodiment together with the drawings in which.

DETAILED DESCRIPTION OF THE PREFERRED EMBODIMENTS

Figure 1:
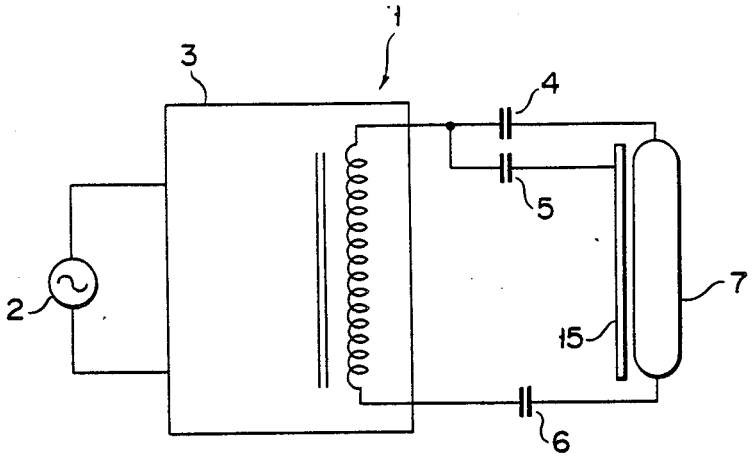
FIG. 1 is a schematic view generally showing a rare gas discharge lamp device according to a first embodiment of this invention.

A rare gas discharge lamp device according to a first embodiment of this invention will be explained below with respect to FIGS. 1 to 3.

Rare gas discharge lamp device 1 includes high-frequency lighting circuit 3, capacitors 4 and 6 and rare gas discharge lamp 7. High-frequency lighting circuit 3 is connected to AC current source 2, such as a commercial power source. Two output terminals of high-frequency lighting circuit 3 are connected respectively through capacitors 4 and 6 to the corresponding internal electrodes of discharge lamp 7. Capacitors 4 and 6 have, for example, 150 pF and 220 pF, respectively.

Figure 2:
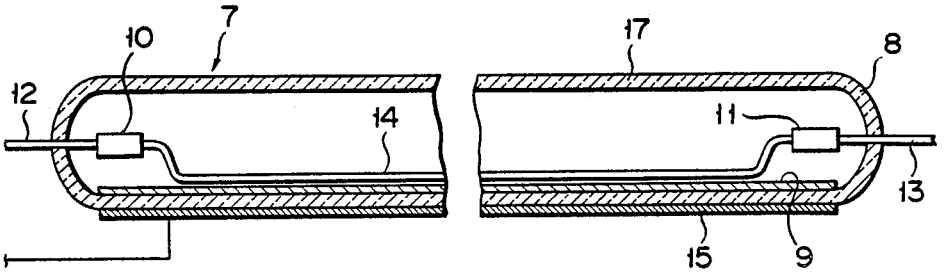
FIG. 2 is a longitudinal cross-sectional view showing the rare gas discharge lamp of FIG. 1.
Figure 3:
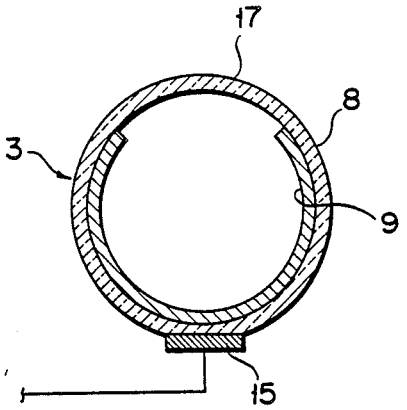
FIG. 3 is a transverse cross-sectional view showing the rare gas discharge lamp of FIG. 2.

In FIGS. 2 and 3, discharge lamp 7 is disclosed, in more detail. Tubular bulb 8 is formed of quartz glass or soft or hard glass. The inner diameter of the bulb 8 is, for example, 2 mm to 10 mm. A rare gas containing xenon as a principal component is sealed into bulb 8 at a pressure of, for example, 30 to 160 torrs.

The light output range increases in proportion to the gas pressure.

A pair of internal electrodes 10, 11 of mutually opposite polarities are provided within bulb 8 and set apart from each other along the axis of the bulb 8. Internal electrodes 10 and 11 are made of, for example, nickel. Lead wires 12 and 13 hermetically penetrate the end wall of bulb 8 and are connected to high-frequency lighting circuit 3. Phosphor layer 9 is formed on the inner surface of bulb 8.

Rare gas discharge lamp 7 has window 17 to control the direction of illumination. Visible light emitting from phosphor layer 9 passes through window 17 and is directed at an illumination surface. In this embodiment, phosphor layer 9 is formed on the inner surface of bulb 8 with window 17 partially formed therein.

Auxiliary electrode 15 is formed on the outer surface of bulb 8 over substantially the whole length of bulb 8 and located, preferably, opposite window 17 across bulb 8. Auxiliary electrode 15 is formed by coating, for example, a paste-like Cu-C mixture at a proper place on the outer surface of the side wall of bulb 8 and sintering it.

Auxiliary electrode 15 is connected, through capacitor 5, to a junction between capacitor 4 and one of the output terminals of high-frequency lighting circuit 3 as shown in FIG. 1. In this case, capacitor 5 has a capacitance of 330 pF.

The operation of the rare gas discharge lamp device will now be explained below.

When discharge lamp 7 is to be lighted, the frequency of AC power source 2 is converted by high-frequency lighting circuit 3 to a high frequency of, for example, 30 kHz. The high-frequency current is carried to internal electrodes 10 and 11 of discharge lamp 7, whereby a glow discharge occurs across internal electrodes 10 and 11 to produce positive column 14, as shown in FIG. 2, in which case the lamp current is 7 mA.

When auxiliary electrode 15 is not mounted on bulb 8, positive column 14 is unstably fluctuated in the direction of the diameter of bulb 8 as previously set forth above. In this embodiment, auxiliary electrode 15 extends over substantially the whole length of bulb 8 and, due to the function of capacitors 4, 5 and 6, a potential difference is created between auxiliary electrode 15 and internal electrode 10 or 11. Positive column 14 occurs between internal electrodes 10 and 11 due to that potential difference and is attracted toward auxiliary electrode 15 over substantially the whole length of bulb 8. As a result, positive column 14 is uniformly located in proximity to phosphor layer 9, obtaining a stable positive column. Thus the light output of rare gas discharge lamp 7 is uniformly distributed along the longitudinal direction. Due to the close proximity of positive column 14 to phosphor layer 9, the phosphor layer increases the light emission strength and, furthermore, rare gas discharge lamp 7 produces an increased light output. In this case, since auxiliary electrode 15 is located opposite window 17 across bulb 8, visible light is output through window 17 from phosphor layer 9 with high efficiency.

Here, even if the auxiliary electrode is connected directly to the internal electrode at the same potential level, the positive column partially floats without being attracted toward the auxiliary electrode, thereby disturbing the distribution pattern of light. It is, therefore, necessary that the auxiliary electrode be placed at a potential level different from that of the internal electrode.

Figure 4:
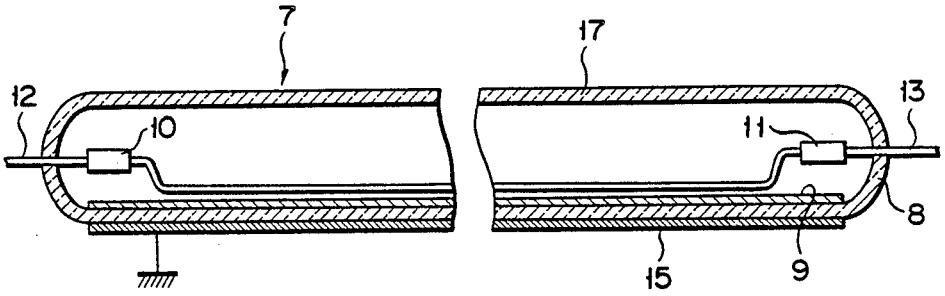
FIG. 4 is a longitudinal view showing a rare gas discharge lamp device according to a second embodiment of this invention.
Figure 5:
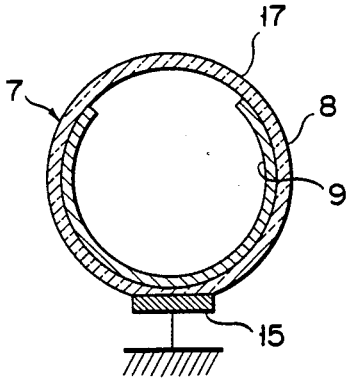
FIG. 5 is a transverse cross-sectional view showing the rare gas discharge lamp of FIG. 4.

FIGS. 4 and 5 show a rare gas discharge lamp device according to a second embodiment of this invention. In the second embodiment, auxiliary electrode 15 is grounded instead of being connected through a capacitor to high-frequency lighting circuit 3. With auxiliary electrode 15 grounded, a potential difference exists between auxiliary electrode 15 and internal electrode 10 or 11. Thus the second embodiment can obtain substantially the same effect as the first embodiment.

Figure 6:
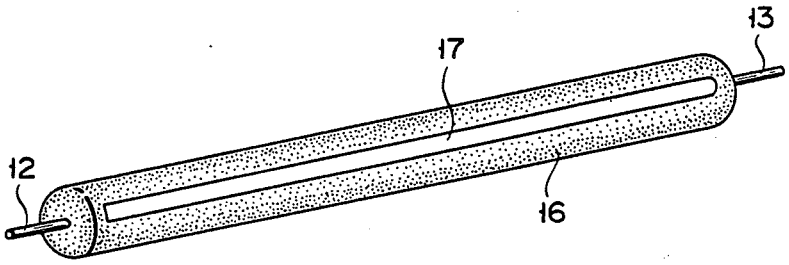
FIG. 6 is a perspective view showing a light shielding layer formed on the rare gas discharge lamp device according to a third embodiment of this invention.
Figure 7:
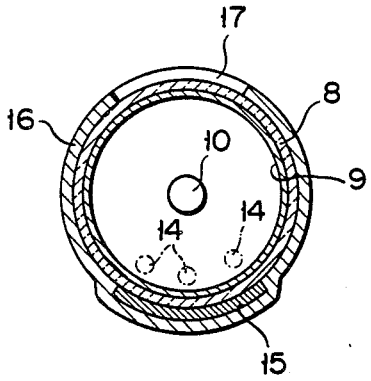
FIG. 7 is a transverse cross-sectional view showing the rare gas discharge lamp of FIG. 6.

As set out above, window 17 is provided in rare gas discharge lamp 7 and acts as a means for controlling the illumination direction of the visible light emitted from the phosphor layer. In order to positively control the illumination direction, light shielding layer 16 is formed on the outer surface of bulb 8, as shown in a third embodiment of FIGS. 6 and 7, with window 17 still included in which case phosphor layer 9 may be formed over the whole inner surface of the side wall of bulb 8. Since light shield layer 16 is formed and the visible light emitting from the phosphor layer is radiated only through window 17, so that the visible light is controlled in its illumination direction and thus increased illumination can be obtained on a surface to be illuminated.

Figure 8:
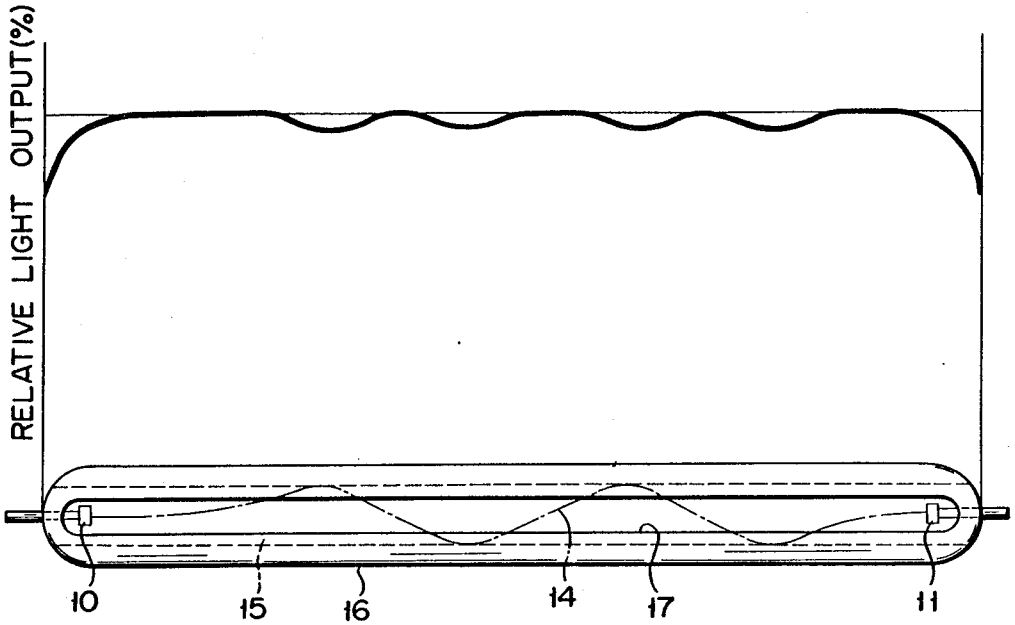
FIG. 8 is a graph showing the light output of the rare gas discharge lamp as shown in FIG. 6.
Figure 9:
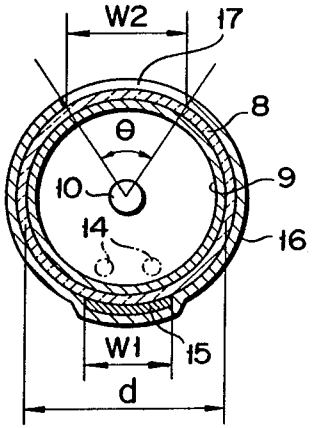
FIG. 9 is a transverse cross-sectional view showing a rare gas discharge lamp device according to a fourth embodiment of this invention.

As indicated in the characteristic curve of FIG. 8, the light output of discharge lamp 7 is substantially uniformly distributed along the axial direction of bulb 8 that the lamp can be put to practical use. In FIG. 8, the "relative light output" indicates the light intensities measured at points which are away from the surface of the lamp by a predetermined distance. In the case illustrated in FIG. 8, the predetermined distance is 6 cm. However, the light output shown in FIG. 8 never becomes completely constant along the axial direction of bulb 8 for the following positive column 14 is attracted toward auxiliary electrode 15 and brought into proximity with the inner wall of bulb 8. However, there is a possibility that, if auxiliary electrode 15 is relatively wider, positive column 14 will meander, as indicated by a dash-dot line in FIG. 8. That is, if the width of auxiliary electrode 15 is greater than, or substantially equal to, the width of window 17, positive column 14 meanders with a greater amplitude. When positive column 14 is located near the side edge of auxiliary electrode 15 as indicated by dash dot lines in FIG. 8, the light output is partially shielded by light shielding layer 16, in comparison with the case where positive column 14 is located at the middle of the width of auxiliary electrode 15. As a result, the light output becomes somewhat lower.

In a rare gas discharge lamp device according to a fourth embodiment of this invention, an auxiliary electrode is provided whose width $W_1$ is narrower than the width $W_2$ of window 17.

Stated in more detail, bulb 8 has an internal diameter d of 4.8 mm (an external diameter of 5.8 mm) with the included angle $\theta$ of window 17 set at an angle of 60°. Thus, the opening $W_2$ of window 17 is formed to be substantially 3.0 mm. On the other hand, the width $W_1$ of auxiliary electrode 15 is 1.8 mm, an adequately small value, when compared with the width $W_2$ of window 17. The included angle $\theta$ is preferably 30° to 90°.

Figure 10:
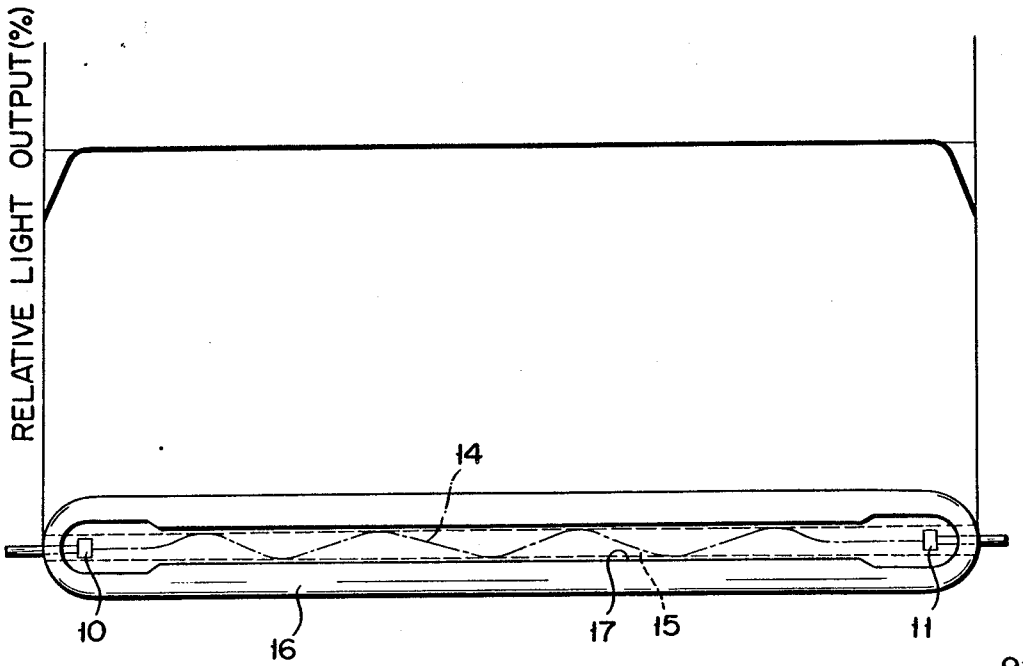
FIG. 10 is a graph showing the light output of the rare gas discharge lamp of FIG. 9.

In this arrangement, at the time of lighting the lamp, positive column 14 is attracted toward auxiliary electrode 15 so that it is brought into proximity with the side wall of bulb 8. In this case, the width $W_1$ of auxiliary electrode 15 is set smaller than the width $W_2$ of window 17 and, even if positive column 14 meanders, the meandering width of positive column 14 becomes smaller than the width of window 17, as shown in FIG. 10. The rare gas discharge lamp 7 thus obtained produces a constant stable light output level along the longitudinal direction.

Figure 11:
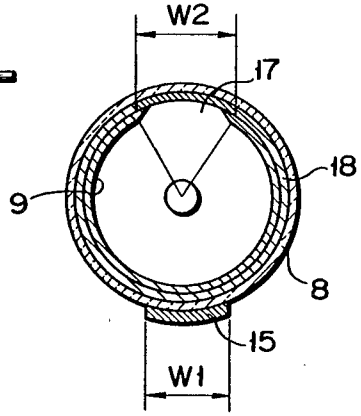
FIG. 11 is a transverse cross-sectional view showing a rare gas discharge lamp device according to a fifth embodiment of this invention.

FIG. 11 shows rare gas discharge lamp 7 according to a fifth embodiment of this invention. In this embodiment, reflective layer 18 is formed between the inner surface of bulb 8 and phosphor layer 9 in place of light shielding layer 16. Reflective layer 18 contributes to controlling the illumination direction of rare gas discharge lamp 7 by the shielding and reflection of the visible light emitting from phosphor layer 9.

While the invention has been described in connection with what is presently considered to be the most practical and preferred embodiments, it is to be understood that the invention is not limited to the disclosed embodiment but, on the contrary is intended to cover various modification and equivalent arrangements included within the spirit and scope of the appended claims.

What is claimed is:

1. A rare gas discharge lamp for producing light using a predetermined voltage comprising:

an elongated bulb having an inner and an outer surface;

a rare gas sealed inside said bulb;

a pair of internal electrodes provided within said bulb and set apart from each other along the longitudinal axis of said bulb, a positive column being produced when the predetermined voltage is applied between said internal electrodes, a phosphor layer formed on said inner surface of said bulb, and means, disposed on said outer surface of said bulb in a region between said electrodes and kept at ground potential, for attracting said positive column toward a portion of said inner surface of said bulb which is close to said attracting means to maintain a potential difference between said attracting means and said positive column between said internal electrodes throughout operation of said rare discharge lamp to obtain a uniform light emission.

2. A rare gas discharge lamp according to claim 1, wherein said attracting means includes:

an auxiliary electrode which is provided along said outer surface of said bulb and extends in the longitudinal direction of said bulb such that the length thereof is substantially equal to the distance between said internal electrodes; and means for producing a potential difference between said auxiliary electrode and each of said internal electrodes.

3. A rare gas discharge lamp according to claim 2, further including a window facing said auxiliary electrode for allowing said light emitted from the lamp to be emitted in a determined direction.

4. A rare gas discharge lamp according to claim 2, wherein said rare gas consists essentially of xenon.

5. A rare gas discharge lamp according to claim 2, wherein said rare gas is filled at a pressure of 30 to 160 torrs.

6. A rare gas discharge lamp according to claim 1, wherein said elongated bulb is cylindrical and has an inside diameter of greater than 2 mm but less than 10 mm.

7. A rare gas discharge lamp according to claim 3, wherein said auxiliary electrode has a width W1 which is smaller than a width W2 of said window as viewed in a circumferential direction.

8. A rare gas discharge lamp according to claim 7, wherein said window is formed through the absence of said phosphor layer over a part of said inner surface of said bulb.

9. A rare gas discharge lamp according to claim 7, wherein a light shielding layer is formed on an outer surface of said bulb except at said window.

10. A rare gas discharge lamp according to claim 7, wherein a reflective layer is partially formed between said inner surface of the bulb and said phosphor layer.

11. A rare gas discharge lamp according to claim 7, wherein said width W2 of said window is determined by an included angle $\theta$, said angle $\theta$, determined with reference to the longitudinal axis of said bulb and being between 30° and 90°.

12. A rare gas discharge lamp for producing light comprising:

a lamp which includes:

a tubular bulb, a rare gas sealed within said bulb, a pair of internal electrodes provided within said bulb and set apart from each other along the longitudinal axis of said bulb, and a phosphor layer formed on an inner surface of said bulb;

a lighting circuit connected to said internal electrodes to apply voltage across said internal electrodes to produce a positive column across said internal electrodes; and means; disposed on the outside of said bulb in a region between said electrodes and kept at ground potential, for attracting the positive column toward a portion of said inner surface of said bulb which is close to said attracting means to maintain a potential difference between said attracting means and said positive column between said internal electrodes throughout operation of said rare gas discharge lamp to obtain a uniform light emission.

13. A rare gas discharge lamp device according to claim 12, wherein said rare gas consists principally of xenon.

14. A rare gas discharge lamp device according to claim 12, wherein said rare gas is filled at a pressure of 30 to 160 torrs.

15. A rare gas discharge lamp device according to claim 14, wherein said bulb has an inside diameter of greater than 2 mm but less than 10 mm.

16. A rare gas discharge lamp device according to claim 12, wherein said auxiliary electrode has a width W1 which is smaller than a width W2 of said window as viewed in a circumferential direction.

17. A rare gas discharge lamp device according to claim 16, wherein said width W2 of said window is determined by an included angle $\theta$, said angle $\theta$ determined with reference to the longitudinal axis of said bulb and being between 30° and 90°.

18. A rare gas discharge lamp according to claim 12, wherein said attracting means include:

an auxiliary electrode provided along an outer surface of said bulb which extends in the longitudinal direction of said bulb and has a length which is substantially equal to the distance between said internal electrodes; and means for producing a potential difference between said auxiliary electrode and each of said internal electrodes.

19. A rare gas discharge lamp device according to claim 18, further including a window facing said auxiliary electrode for allowing said light to be emitted in a determined direction.

20. A rare gas discharge lamp device according to claim 19, wherein said window is formed through the absence of said phosphor layer formed on said inner surface of said bulb.

21. A rare gas discharge lamp device according to claim 19, wherein a light shielding layer is formed on an outer surface of said bulb except at said window.

22. A rare gas discharge lamp device according to claim 12, wherein a reflective layer is partially formed between said inner surface of said bulb and said phosphor layer.

23. A rare gas discharge lamp device according to claim 18, wherein said auxiliary electrode is connected to said lighting circuit through a capacitor to produce a phase difference between the voltage applied to the internal electrodes and the voltage applied to the auxiliary electrode.

24. A rare gas discharge lamp device according to claim 18, wherein said auxiliary electrode is grounded to obtain said potential difference between said internal electrodes and said auxiliary electrode.

* * * * *